US011744276B2

(12) United States Patent
Deforel et al.

(10) Patent No.: US 11,744,276 B2
(45) Date of Patent: Sep. 5, 2023

(54) METHOD OF MAKING A NICOTINE CONTAINING SHEET

(71) Applicant: Philip Morris Products S.A., Neuchatel (CH)

(72) Inventors: Corinne Deforel, Formangueires (CH); Judith Waller, Peseux (CH); Gerard Zuber, Froideville (CH)

(73) Assignee: Philip Morris Products S.A., Neuchatel (CH)

( * ) Notice: Subject to any disclaimer, the term of this patent is extended or adjusted under 35 U.S.C. 154(b) by 172 days.

(21) Appl. No.: 16/473,103

(22) PCT Filed: Dec. 21, 2017

(86) PCT No.: PCT/EP2017/084095
§ 371 (c)(1),
(2) Date: Jun. 24, 2019

(87) PCT Pub. No.: WO2018/122097
PCT Pub. Date: Jul. 5, 2018

(65) Prior Publication Data

US 2019/0328030 A1 Oct. 31, 2019

(51) Int. Cl.
*A24B 15/14* (2006.01)
*A24B 3/14* (2006.01)
*A24C 5/01* (2020.01)

(52) U.S. Cl.
CPC ..... *A24B 15/14* (2013.01); *A24B 3/14* (2013.01); *A24C 5/01* (2020.01)

(58) Field of Classification Search
CPC ..... A24B 3/14; A24B 15/14; A24C 5/01
See application file for complete search history.

(56) References Cited

U.S. PATENT DOCUMENTS 3,385,303 A * 5/1968 Hind ..... A24B 15/12 131/353
3,718,153 A * 2/1973 Kobari et al. ..... A24B 15/12 131/370
3,949,762 A 4/1976 West et al.
(Continued)

FOREIGN PATENT DOCUMENTS

CH 691 156 A5 5/2001
CN 101606748 A 12/2009
(Continued)

OTHER PUBLICATIONS

Combine Russian Federation Office Action and Search Report dated Feb. 17, 2020 in Russian Federation Patent Application No. 2019123593/03(046021) (with English translation), 12 pages.
(Continued)

*Primary Examiner* — Kelly M Gambetta
*Assistant Examiner* — Jennifer A Kessie
(74) *Attorney, Agent, or Firm* — Oblon, McClelland, Maier & Neustadt, L.L.P.

(57) ABSTRACT

A method of making a nicotine containing sheet is provided, including steps of combining a source of nicotine salt having a cellulose content of less than about 5% by weight on a dry weight basis with a separate source of fibrous material having a nicotine salt content of less than about 5% by weight on a dry weight basis to form a mixture; and drying the mixture to form a sheet.

14 Claims, 1 Drawing Sheet

(56) References Cited

U.S. PATENT DOCUMENTS

| | | | | |
|---|---|---|---|---|
| 5,778,899 | A * | 7/1998 | Saito | A24B 15/10 131/194 |
| 2014/0166032 | A1* | 6/2014 | Gindrat | A24D 1/002 131/353 |
| 2014/0261504 | A1* | 9/2014 | Griscik | B29C 43/006 131/352 |
| 2016/0106143 | A1* | 4/2016 | Mei | A24B 15/14 131/374 |
| 2016/0213063 | A1 | 7/2016 | Ajithkumar et al. | |

FOREIGN PATENT DOCUMENTS

| | | | |
|---|---|---|---|
| CN | 104427890 | A | 3/2015 |
| EP | 0 822 760 | A2 | 2/1998 |
| GB | 1 355 865 | | 6/1974 |
| GB | 1 495 941 | | 12/1977 |
| JP | 51-148099 | A | 12/1976 |
| JP | 55-2275 | | 1/1980 |
| JP | 2016-536008 | A | 11/2016 |
| RU | 2 401 621 | C1 | 10/2010 |
| WO | WO 96/32854 | A2 | 10/1996 |
| WO | WO 2006/070288 | A2 | 7/2006 |
| WO | WO 2009/022232 | A2 | 2/2009 |
| WO | WO 2009/132793 | A1 | 11/2009 |
| WO | WO 2012/164009 | A2 | 12/2012 |
| WO | WO 2013/098405 | A2 | 7/2013 |
| WO | WO 201 3/190036 | A1 | 12/2013 |
| WO | WO 201 5/055567 | A1 | 4/2015 |
| WO | WO 2015/082652 | A1 | 6/2015 |
| WO | WO-2015082652 | A1 * | 6/2015 ..... A24B 15/165 |
| WO | WO 201 6/023965 | A1 | 2/2016 |

OTHER PUBLICATIONS

International Search Report and Written Opinion dated Mar. 29, 2018 in PCT/EP2017/084095 filed Dec. 21, 2017.

Combined Chinese Office Action and Search Report dated May 8, 2021 in corresponding Chinese Patent Application No. 201780074981.6 (with English Translation), 21 pages Japanese Office Action dated Dec. 22, 2021 in corresponding Japanese Patent Application No. 2019-530128 (with English translation), 9 pages.

* cited by examiner

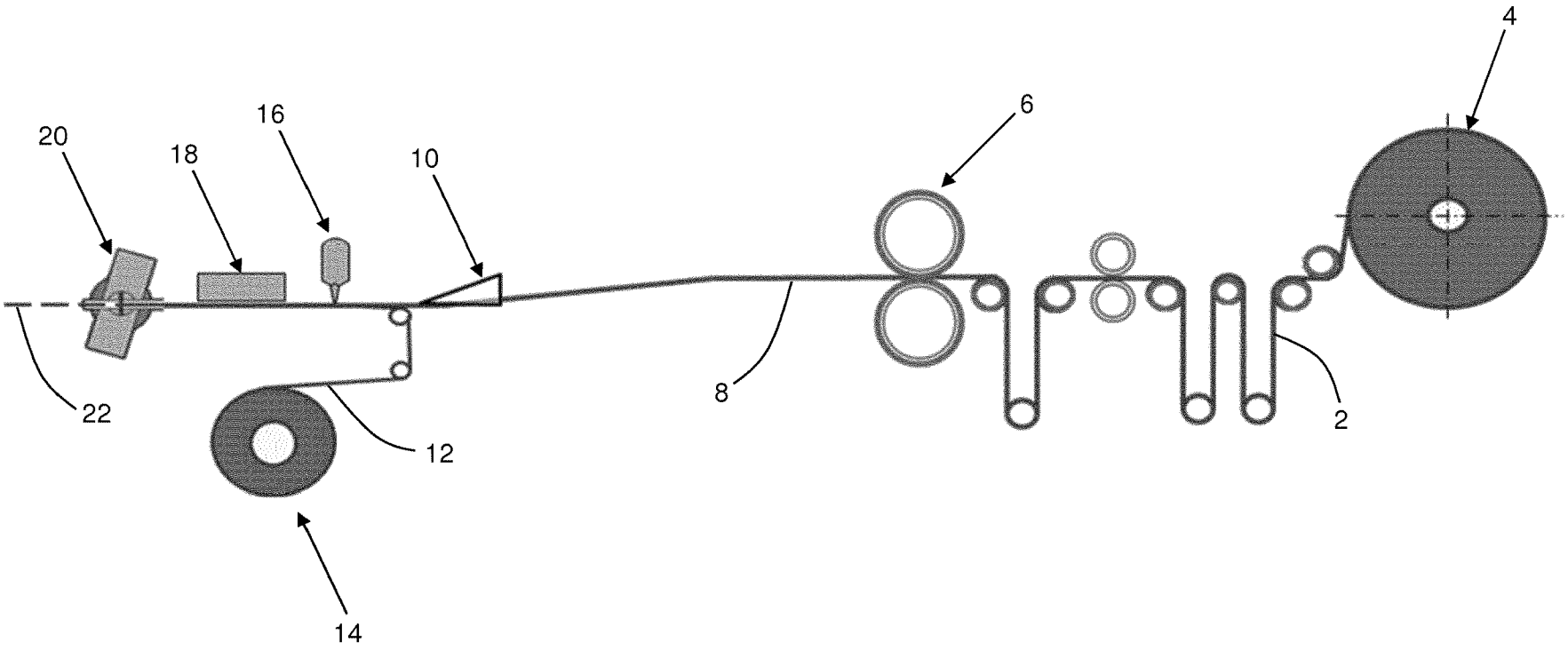
4
2
6
8
10
12
14
16
18
20
22

METHOD OF MAKING A NICOTINE CONTAINING SHEET

The present invention relates to methods of making sheets comprising nicotine. The present invention also relates to methods of making aerosol-generating rods comprising gathered sheets comprising nicotine.

Electronic cigarettes (so-called 'e-cigarettes') and other electrically-operated smoking devices that vaporise a liquid formulation comprising nicotine to form a nicotine-containing aerosol that is inhaled by a user are known in the art. For example, WO 2009/132793 A1 discloses an electrically heated smoking system comprising a shell and a replaceable mouthpiece wherein the shell comprises an electric power supply and electric circuitry. The mouthpiece comprises a liquid storage portion, a capillary wick having a first end that extends into the liquid storage portion for contact with liquid therein, and a heating element for heating a second end of the capillary wick. In use, liquid is transferred from the liquid storage portion towards the heating element by capillary action in the wick. Liquid at the second end of the wick is vaporised by the heating element.

Handling of the liquid formulations used in e-cigarettes may be cumbersome or undesirable for a user. It would be desirable to provide aerosol-generating articles that provide a similar nicotine delivery to conventional cigarettes and that do not require the handling of a liquid formulation by the user.

According to the invention there is provided a method of making a nicotine containing sheet comprising the steps of: combining a source of nicotine salt having a cellulose content of less than about 5% by weight on a dry weight basis with a separate source of fibrous material having a nicotine salt content of less than about 5% by weight on a dry weight basis to form a mixture; and drying the mixture to form a sheet.

According to the invention there is also provided a method of making an aerosol-generating rod comprising the steps of: combining a source of nicotine salt having a cellulose content of less than about 5% by weight on a dry weight basis with a separate source of fibrous material having a nicotine salt content of less than about 5% by weight on a dry weight basis to form a mixture; drying the mixture to form a sheet; gathering the sheet transversely relative to a longitudinal axis thereof; circumscribing the gathered sheet with a wrapper to form a rod; and severing the rod into a plurality of discrete aerosol-generating rods.

As used herein with reference to the invention, the term "sheet" denotes a laminar element having a width and length substantially greater than the thickness thereof.

As used herein with reference to the invention, the term "rod" is used to describe a generally cylindrical element of substantially circular, oval or elliptical cross-section.

As used herein with reference to the invention, the term "gathered" denotes that the sheet is convoluted, folded, or otherwise compressed or constricted substantially transversely to the cylindrical axis of the rod.

Sheets made by methods according to the invention do not comprise flowable liquid. Consequently, users of aerosol-generating articles comprising aerosol-generating rods made by methods according to the invention are advantageously not required to handle liquid formulations.

E-cigarettes typically use a liquid formulation comprising free nicotine base. Nicotine salts may be more stable than free nicotine base. Consequently, sheets made by methods according to the invention and aerosol-generating rods made by methods according to the invention may advantageously have longer shelf lives than liquid formulations typical used in e-cigarettes.

Aerosol-generating rods made by methods according to the invention may generate a nicotine-containing aerosol when heated to temperatures lower than about 300° C. For example, aerosol-generating rods made by methods according to the invention may generate a nicotine-containing aerosol when heated to temperatures lower than about 250° C. or lower than about 220° C. Aerosol-generating rods made by methods according to the invention may generate a nicotine-containing aerosol when heated to temperatures as low as between about 120° C. and about 140° C. Consequently, there may advantageously be no need to use a large device with high battery power in order to generate aerosols with high levels of nicotine from aerosol-generating rods made by methods according to the invention.

The source of nicotine salt may have a cellulose content of less than about 4% by weight on a dry weight basis, less than about 3% by weight on a dry weight basis, less than about 2% by weight on a dry weight basis or less than about 1% by weight on a dry weight basis.

The source of nicotine salt may comprise substantially no cellulosic material.

The source of nicotine salt may have a nicotine salt content of at least about 96% by weight on a dry weight basis, at least about 97% by weight on a dry weight basis, at least about 98% by weight on a dry weight basis or at least about 99% by weight on a dry weight basis. The source of nicotine salt may have a nicotine salt content of about 100% by weight on a dry weight basis.

Advantageously, the weight ratio of nicotine salt to cellulose in the source of nicotine salt on a dry weight basis is at least about 25:1, at least about 40:1, at least about 50:1 or at least about 100:1.

The source of nicotine salt may comprise one or more nicotine salts.

For example, the source of nicotine salt may comprise one or more salts of acids selected from the group consisting of acetic acid, benzoic acid, carbonic acid, citric acid, gallic acid, hydrochloric acid, lactic acid, lauric acid, levulinic acid, malic acid, malonic acid, oxalic acid, oxaloacetic acid, palmitic acid, pyruvic acid, phosphoric acid, salicylic acid, sorbic acid, stearic acid, sulfuric acid and tartaric acid.

Advantageously, the source of nicotine salt may comprise one or more nicotine salts of carboxylic acids.

Advantageously, the source of nicotine salt may comprise one or more monoprotic nicotine salts.

As used herein, the term "monoprotic nicotine salt" is used to describe a nicotine salt of a monoprotic acid.

Advantageously, the source of nicotine salt comprises one or more nicotine salts of monoprotic carboxylic acids.

Advantageously, the source of nicotine salt may comprise one or more nicotine salts of monoprotic carboxylic acids selected from the group consisting of acetic acid, benzoic acid, gallic acid, lactic acid, lauric acid, levulinic acid, palmitic acid, pyruvic acid, sorbic acid and stearic acid. The source of nicotine salt may comprise one or more polyprotic nicotine salts.

As used herein, the term "polyprotic nicotine salt" is used to describe a nicotine salt of a polyprotic acid.

For example, the source of nicotine salt may comprise one or more nicotine salts of diprotic carboxylic acids such as malic acid, oxalic acid and tartaric acid.

For example, the source of nicotine salt may comprise one more nicotine salts of triprotic carboxylic acids such as citric acid.

Advantageously, at least about 20% by weight of the nicotine salts in the source of nicotine salt are monoprotic.

For example, at least about 30% by weight, at least about 40% by weight, at least about 50% by weight, at least about 60% by weight, at least about 70% by weight, at least about 80% by weight or at least about 90% by weight of the nicotine salts in the source of nicotine salt may be monoprotic.

Advantageously, the source of nicotine salt may comprise five or fewer nicotine salts. The source of nicotine salt may comprise four or fewer nicotine salts, three or fewer nicotine salts or two or fewer nicotine salts.

Advantageously the weight ratio of major nicotine salt to total nicotine salt in the source of nicotine salt on a dry weight basis may be at least about 2:3.

As used herein with reference to the source of nicotine salt, the term "major nicotine salt" is used to describe the nicotine salt in the source of nicotine salt in the greatest amount by weight on a dry weight basis.

The weight ratio of major nicotine salt to total nicotine salt in the source of nicotine salt on a dry weight basis may advantageously be at least about 3:4, at least about 4:5 or at least about 5:6.

Advantageously, the source of nicotine salt may comprise a single nicotine salt.

More advantageously, the source of nicotine salt may comprise a single monoprotic nicotine salt.

Most advantageously, the source of nicotine salt may comprise a single nicotine salt of a monoprotic carboxylic acid.

Advantageously, the source of nicotine salt may comprise one or more nicotine salts of acids having an atmospheric boiling point of between about 150° C. and about 350° C.

The source of nicotine salt may advantageously comprise one or more nicotine salts of acids having an atmospheric boiling point of between about 230° C. and about 270° C.

The combining step may comprise combining the source of nicotine salt and the source of fibrous material with one or more additional components to form the mixture.

Advantageously, at least about 20% by weight of the nicotine salts in the mixture are monoprotic.

For example, at least about 30% by weight, at least about 40% by weight, at least about 50% by weight, at least about 60% by weight, at least about 70% by weight, at least about 80% by weight or at least about 90% by weight of the nicotine salts in the mixture may be monoprotic.

It will be appreciated that sheets made by methods according to the invention may have the same percentages by weight on a dry weight basis and weight ratios on a dry weight basis of components as the mixtures formed in the combining steps of methods according to the invention.

Advantageously, the mixture may comprise five or fewer nicotine salts.

The mixture may comprise four or fewer nicotine salts, three or fewer nicotine salts or two or fewer nicotine salts.

Advantageously the weight ratio of major nicotine salt to total nicotine salt in the mixture on a dry weight basis may be at least about 2:3.

As used herein with reference to the mixture, the term "major nicotine salt" is used to describe the nicotine salt in the mixture in the greatest amount by weight on a dry weight basis.

Advantageously, the mixture may comprise a single nicotine salt.

The weight ratio of major nicotine salt to total nicotine salt in the mixture on a dry weight basis may advantageously be at least about 3:4, at least about 4:5 or at least about 5:6.

More advantageously, the mixture may comprise a single monoprotic nicotine salt.

Most advantageously, the mixture may comprise a single nicotine salt of a monoprotic carboxylic acid.

Inclusion of a single nicotine salt may advantageously allow for better control of the aerosol formed by heating an aerosol-generating rod comprising the sheet at a specific temperature and over time.

Advantageously, the mixture may have a total nicotine salt content of at least about 1% by weight on a dry weight basis.

The mixture may advantageously have a total nicotine salt content of at least about 2% by weight on a dry weight basis or at least about 3% by weight on a dry weight basis.

Advantageously, the mixture may have a total nicotine salt content of less than about 30% by weight on a dry weight basis.

The mixture may advantageously have a total nicotine salt content of less than about 30% by weight on a dry weight basis, less than about 20% by weight on a dry weight basis, less than about 10% by weight on a dry weight basis or less than about 6% by weight on a dry weight basis.

The mixture may have a total nicotine salt content of less than about 5% by weight on a dry weight basis or less than about 4% by weight on a dry weight basis.

The mixture may have a total nicotine salt content of between about 1% and about 30% by weight on a dry weight basis, between about 1% and about 20% by weight on a dry weight basis, between about 1% and about 10% by weight on a dry weight basis, between about 1% and about 6% by weight on a dry weight basis, between about 1% and about 5% by weight on a dry weight basis or between about 1% and about 4% by weight on a dry weight basis.

The mixture may have a total nicotine salt content of between about 2% and about 30% by weight on a dry weight basis, between about 2% and about 20% by weight on a dry weight basis, between about 2% and about 10% by weight on a dry weight basis, between about 2% and about 6% by weight on a dry weight basis, between about 2% and about 5% by weight on a dry weight basis or between about 2% and about 4% by weight on a dry weight basis.

The mixture may have a total nicotine salt content of between about 3% and about 30% by weight on a dry weight basis, between about 3% and about 20% by weight on a dry weight basis, between about 3% and about 10% by weight on a dry weight basis, between about 3% and about 6% by weight on a dry weight basis, between about 3% and about 5% by weight on a dry weight basis or between about 3% and about 4% by weight on a dry weight basis.

Advantageously, the mixture may have a tobacco nicotine salt content of less than about 0.5% by weight on a dry weight basis.

As used herein with reference to the invention, the term "tobacco nicotine salt" is used to describe nicotine salts occurring naturally in any tobacco material in the mixture.

The mixture may have a tobacco nicotine salt content of less than about 0.4% by weight on a dry weight basis, less than about 0.3% by weight on a dry weight basis, less than about 0.2% by weight on a dry weight basis on less than about 0.1% by weight on a dry weight basis. Advantageously, the weight ratio of tobacco nicotine salt to total nicotine salt in the mixture on a dry weight basis may be less than about 1:5.

The weight ratio of tobacco nicotine salt to total nicotine salt in the mixture on a dry weight basis may advantageously be less than about 1:10, less than about 1:15 or less than about 1:25.

The mixture may contain substantially no tobacco nicotine salt.

The percentages by weight and weight ratios of nicotine salts recited herein are those measured by liquid chromatography.

Advantageously, the source of fibrous material may comprise cellulose fibres or nylon. More advantageously, the source of fibrous material may comprise cellulose fibres. The source of fibrous material may have a nicotine salt content of less than about 4% by weight on a dry weight basis, less than about 3% by weight on a dry weight basis, less than about 2% by weight on a dry weight basis or less than about 1% by weight on a dry weight basis.

The source of fibrous material may comprise substantially no nicotine salts.

The source of fibrous material may have a fibrous material content of at least about 96% by weight on a dry weight basis, at least about 97% by weight on a dry weight basis, at least about 98% by weight on a dry weight basis or at least about 99% by weight on a dry weight basis. The source of fibrous material may have a fibrous material content of about 100%.

Advantageously, the weight ratio of fibrous material to nicotine salt in the source of fibrous material on a dry weight basis is at least about 25:1, at least about 40:1, at least about 50:1 or at least about 100:1.

Advantageously, the mixture may have a total fibrous material content of at least about 1% by weight on a dry weight basis.

Advantageously, the mixture may have a total fibrous material content of less than about 70% by weight on a dry weight basis.

The mixture may have a total fibrous material content of less than about 60% by weight on a dry weight basis, less than about 50% by weight on a dry weight basis, less than about 40% by weight on a dry weight basis, less than about 30% by weight on a dry weight basis, less than about 20% by weight on a dry weight basis or less than about 10% by weight on a dry weight basis The mixture may have a total fibrous material content of between about 1% and about 70% by weight on a dry weight basis, between about 1% and about 60% by weight on a dry weight basis, between about 1% and about 50% by weight on a dry weight basis, between about 1% and about 40% by weight on a dry weight basis, between about 1% and about 30% by weight on a dry weight basis, between about 1% and about 20% by weight on a dry weight basis or between about 30% and about 10% by weight on a dry weight basis.

Advantageously, the weight ratio of fibrous material to nicotine salt in the mixture on a dry weight basis may be between about 30:1 and about 1:5 or between about 15:1 and about 1:3.

The combining step may comprise combining the source of nicotine salt, the source of fibrous and one or more additional components in a single step to form the mixture.

The combining step may comprise combining the source of nicotine salt, the source of fibrous and one or more additional components in multiple steps to form the mixture.

For example, the combining step may comprise combining the source of nicotine salt, the source of fibrous and one or more additional components in two steps or three steps to form the mixture.

The combining step may comprise: a first step of combining the source of nicotine salt and the source of fibrous material to form a premixture; and a second step of combining one or more additional components with the premixture to form the mixture.

The combining step may comprise: a first step of combining the source of nicotine salt and one or more additional components to form a premixture; and a second step of combining the source of fibrous material with the premixture to form the mixture.

The combining step may comprise: a first step of combining the source of fibrous material and one or more additional components to form a premixture; and a second step of combining the source of nicotine salt with the premixture to form the mixture.

The combining step may comprise: a first step of combining the source of nicotine salt and the source of fibrous material to form a first premixture; a second step of combining one or more additional components to form a second premixture; and a third step of combining the first premixture and the second premixture to form the mixture.

The combining step may comprise: a first step of combining the source of nicotine salt and one or more additional components to form a first premixture; a second step of combining the source of fibrous material and one or more additional components to form a second premixture; and a third step of combining the first premixture and the second premixture to form the mixture.

Advantageously, the combining step may comprise combining cellulose powder with the source of nicotine salt and the source of fibrous material to form the mixture.

Advantageously, the cellulose powder may have an average particle size of less than about 60 microns. Inclusion of cellulose powder having an average particle size of less than about 60 microns may facilitate formation of the sheet.

Advantageously the weight ratio of cellulose powder to total cellulosic material in the mixture on a dry weight basis may be greater than about 1:2.

The weight ratio of cellulose powder to total cellulosic material in the mixture on a dry weight basis may advantageously be greater than about 2:3, greater than about 3:4, greater than about 4:5 or greater than about 5:6.

Advantageously, the weight ratio of cellulose powder to nicotine salt in the mixture on a dry weight basis may be between about 18:1 and about 5:1 or between about 16:1 and about 8:1.

Advantageously, the weight ratio of cellulose powder to fibrous material in the mixture on a dry weight basis may be between about 30:1 and about 10:1 or between about 25:1 and about 15:1.

Advantageously, the mixture may have a total cellulosic material content of at least about 30% by weight on a dry weight basis.

The mixture may have a total cellulosic material content of at least about 35% by weight on a dry weight basis or at least about 40% by weight on a dry weight basis.

Advantageously, the mixture may have a total cellulosic material content of less than about 60% by weight on a dry weight basis.

The mixture may have a total cellulosic material content of less than about 55% by weight on a dry weight basis or less than about 50% by weight on a dry weight basis.

The mixture may have a total cellulosic material content of between about 30% and about 60% by weight on a dry weight basis, between about 30% and about 55% by weight on a dry weight basis or between about 30% and about 50% by weight on a dry weight basis.

The mixture may have a total cellulosic material content of between about 35% and about 60% by weight on a dry weight basis, between about 35% and about 55% by weight on a dry weight basis or between about 35% and about 50% by weight on a dry weight basis.

The mixture may have a total cellulosic material content of between about 40% and about 60% by weight on a dry weight basis, between about 40% and about 55% by weight on a dry weight basis or between about 40% and about 50% by weight on a dry weight basis.

Advantageously, the combining step may comprise combining sugar with the source of nicotine salt and the source of fibrous material to form the mixture.

As used herein with reference to the invention, the term "sugar" is used to describe monosaccharides, disaccharides, oligosaccharides comprising three to ten monosaccharide units and sugar alcohols.

Inclusion of sugar may advantageously improve the malleability and pliability of the sheet compared to a sheet in which no sugar is included. This may facilitate gathering of the sheet to form a rod as described further below.

The mixture may advantageously comprise one or more sugars selected from the group consisting of disaccharides and sugar alcohols.

For example, the mixture may comprise one or more disaccharides such as lactose, sucrose and trehalose, one or more sugar alcohols such as mannitol and sorbitol or a combination of one or more disaccharides and one or more sugar alcohols.

Advantageously, the weight ratio of reducing sugar to total sugar in the mixture on a dry weight basis may be less than about 1:2.

The percentages by weight and weight ratios of sugars recited herein are those measured by liquid chromatography.

The weight ratio of reducing sugar to total sugar in the mixture on a dry weight basis may advantageously be less than about 1:4, less than about 1:6, less than about 1:8 or less than about 1:10.

The mixture may comprise substantially no reducing sugar.

Advantageously, the weight ratio of cyclic sugar to total sugar in the mixture on a dry weight basis may be less than about 1:3.

The weight ratio of cyclic sugar to total sugar in the mixture on a dry weight basis may advantageously be less than about 1:4, less than about 1:6, less than about 1:8 or less than about 1:10.

The mixture may comprise substantially no cyclic sugar.

Advantageously, the weight ratio of formaldehyde-generating sugar to total sugar in the mixture on a dry weight basis may be less than about 1:3.

As used herein with reference to the invention, the term "formaldehyde-generating sugar" is used to describe sugar that when pyrolysed can lead to the formation of formaldehyde.

The weight ratio of formaldehyde-generating sugar to total sugar in the mixture on a dry weight basis may advantageously be less than about 1:4, less than about 1:6, less than about 1:8 or less than about 1:10.

The mixture may comprise substantially no formaldehyde-generating sugar.

Advantageously, the mixture may comprise one or more sugars alcohols.

Advantageously, the mixture may have a sugar alcohol content of at least about 10% by weight on a dry weight basis.

The mixture may have a sugar alcohol content of at least about 15% by weight on a dry weight basis, at least about 20% by weight on a dry weight basis or at least about 25% by weight on a dry weight basis.

Advantageously, the mixture may have a sugar alcohol content of less than about 40% by weight on a dry weight basis.

The mixture may have a sugar alcohol content of less than about 35% by weight on a dry weight basis or less than about 30% by weight on a dry weight basis.

The mixture may have a sugar alcohol content of between about 10% and about 40% by weight on a dry weight basis, between about 10% and about 35% by weight on a dry weight basis or between about 10% and about 30% by weight on a dry weight basis.

The mixture may have a sugar alcohol content of between about 15% and about 40% by weight on a dry weight basis, between about 15% and about 35% by weight on a dry weight basis or between about 15% and about 30% by weight on a dry weight basis.

The mixture may have a sugar alcohol content of between about 20% and about 40% by weight on a dry weight basis, between about 20% and about 35% by weight on a dry weight basis or between about 20% and about 30% by weight on a dry weight basis.

The mixture may have a sugar alcohol content of between about 25% and about 40% by weight on a dry weight basis, between about 25% and about 35% by weight on a dry weight basis or between about 25% and about 30% by weight on a dry weight basis.

Advantageously, the mixture may comprise mannitol, sorbitol or a combination thereof. More advantageously, the mixture may comprise mannitol.

Pyrolysis of sorbitol and mannitol advantageously does not lead to the formation of formaldehyde.

Advantageously the weight ratio of sugar alcohol to total sugar in the mixture on a dry weight basis may be at least about 2:3.

The weight ratio of sugar alcohol to total sugar in the mixture on a dry weight basis may advantageously be at least about 3:4, at least about 4:5 or at least about 5:6.

Advantageously, the mixture may have a total sugar content of at least about 15% by weight on a dry weight basis.

The mixture may have a total sugar content of at least about 20% by weight on a dry weight basis, at least about 25% by weight on a dry weight basis or at least about 30% by weight on a dry weight basis.

Advantageously, the mixture may have a total sugar content of less than about 45% by weight on a dry weight basis.

The mixture may have a total sugar content of less than about 40% by weight on a dry weight basis, less than about 35% by weight on a dry weight basis or less than about 30% by weight on a dry weight basis.

The mixture may have a total sugar content of between about 15% and about 45% by weight on a dry weight basis, between about 15% and about 40% by weight on a dry weight basis, between about 15% and about 35% by weight on a dry weight basis or between about 15% and about 30% by weight on a dry weight basis.

The mixture may have a total sugar content of between about 20% and about 45% by weight on a dry weight basis, between about 20% and about 40% by weight on a dry weight basis, between about 20% and about 35% by weight on a dry weight basis or between about 20% and about 30% by weight on a dry weight basis.

The mixture may have a total sugar content of between about 25% and about 45% by weight on a dry weight basis, between about 25% and about 40% by weight on a dry weight basis, between about 25% and about 35% by weight on a dry weight basis or between about 25% and about 30% by weight on a dry weight basis.

Advantageously, the mixture may have a combined fructose and glucose content of less than about 5% by weight on a dry weight basis.

As used herein with reference to the invention, the term "combined fructose and glucose content" is used to describe the total percentage by weight of fructose and glucose in the mixture.

The mixture may have a combined fructose and glucose content of less than about 3% by weight on a dry weight basis, less than about 2% by weight on a dry weight basis or less than about 1% by weight on a dry weight basis.

Advantageously, the weight ratio of fructose and glucose to total sugar in the mixture on a dry weight basis may be less than about 1:5.

The weight ratio of fructose and glucose to total sugar in the mixture on a dry weight basis may advantageously be less than about 1:10, less than about 1:15 or less than about 1:25.

The mixture may contain substantially no fructose or glucose.

Advantageously, the weight ratio of sugar to nicotine salt in the mixture on a dry weight basis may be between about 12:1 and about 5:2 or between about 10:1 and about 5:1.

Advantageously, the weight ratio of sugar to fibrous material in the mixture on a dry weight basis may be between about 25:1 and about 1:3 or between about 20:1 and about 1:2.

Advantageously, the weight ratio of sugar to cellulose powder in the mixture on a dry weight basis may be between about 4:3 and about 1:2 or between about 1:1 and about 5:9.

Advantageously, the combining step may comprise combining a binder with the source of nicotine salt and the source of fibrous material to form the mixture.

Inclusion of a binder may advantageously facilitate manufacture of the sheet.

Inclusion of a binder may advantageously improve the homogeneity of the sheet compared to a sheet in which no binder is included.

The mixture may comprise a gum binder.

Advantageously, the mixture may comprise a natural gum binder.

Advantageously, the mixture may comprise one or more natural gum binders selected from the group consisting of guar gum, xanthan gum and gum arabic.

Advantageously, the mixture may have a binder content of at least about 1% by weight on a dry weight basis.

The mixture may have a binder content of at least about 2% by weight on a dry weight basis.

Advantageously, the mixture may a have a binder content of less than about 10% by weight on a dry weight basis.

The mixture may have a binder content of less than about 8% by weight on a dry weight basis, less than about 6% by weight on a dry weight basis or less than about 4% by weight on a dry weight basis.

The mixture may have a binder content of between about 1% and about 10% by weight on a dry weight basis, between about 1% and about 8% by weight on a dry weight basis, between about 1% and about 6% by weight on a dry weight basis or between about 1% and about 4% by weight on a dry weight basis.

The mixture may have a binder content of between about 2% and about 10% by weight on a dry weight basis, between about 2% and about 8% by weight on a dry weight basis, between about 2% and about 6% by weight on a dry weight basis or between about 2% and about 4% by weight on a dry weight basis.

Advantageously, the weight ratio of binder to nicotine salt in the mixture on a dry weight basis may be between about 2:1 and about 1:2 or between about 3:2 and about 2:3.

Advantageously, the weight ratio of binder to fibrous material in the mixture on a dry weight basis may be between about 3:1 and about 1:25 or between about 2:1 and about 1:10.

Advantageously, the weight ratio of binder to cellulose powder in the mixture on a dry weight basis may be between about 1:10 and about 1:20 or between about 1:12 and about 1:10.

Advantageously, the weight ratio of binder to sugar in the mixture on a dry weight basis may be between about 1:5 and about 1:15 or between about 1:8 and about 1:12.

1:18.

Advantageously, the combining step may comprise combining an aerosol former with the source of nicotine salt and the source of fibrous material to form the mixture.

Inclusion of an aerosol former may advantageously facilitate formation of a nicotine-containing aerosol upon heating on an aerosol-generating rod comprising the sheet.

The aerosol-former may be any suitable known compound or mixture of compounds that, in use, facilitates formation of a dense and stable aerosol and that is substantially resistant to thermal degradation at the operating temperature of an aerosol-generating article comprising an aerosol-forming substrate comprising the sheet.

Suitable aerosol-formers are known in the art and include, but are not limited to: polyhydric alcohols, such as triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate.

Advantageously, the mixture may comprise one or more polyhydric alcohols.

More advantageously, the mixture may comprise one or more aerosol formers selected from the group consisting of triethylene glycol, 1,3-butanediol and glycerine.

The mixture may advantageously have an aerosol former content of at least about 5% by weight on a dry weight basis.

The mixture may have an aerosol former content of at least about 10% by weight on a dry weight basis or at least about 15% by weight on a dry weight basis.

The mixture may advantageously have an aerosol former content of less than about 35% by weight on a dry weight basis.

The mixture may have an aerosol former content of less than about 30% by weight on a dry weight basis or less than about 25% by weight on a dry weight basis.

The mixture may have an aerosol former content of between about 5% and about 35% by weight on a dry weight basis, between about 5% and about 30% by weight on a dry weight basis or between about 5% and about 25% by weight on a dry weight basis.

The mixture may have an aerosol former content of between about 10% and about 35% by weight on a dry weight basis, between about 10% and about 30% by weight on a dry weight basis or between about 10% and about 25% by weight on a dry weight basis.

The mixture may have an aerosol former content of between about 15% and about 35% by weight on a dry weight basis, between about 15% and about 30% by weight on a dry weight basis or between about 15% and about 25% by weight on a dry weight basis.

Advantageously, the weight ratio of aerosol former to nicotine salt in the mixture on a dry weight basis may be between about 15:1 and about 3:1 or between about 10:1 and about 4:1.

Advantageously, the weight ratio of aerosol former to fibrous material in the mixture on a dry weight basis may be between about 15:1 and about 1:4 or between about 8:1 and about 1:2.

Advantageously, the weight ratio of aerosol former to cellulose powder in the mixture on a dry weight basis may be between about 2:3 and about 1:3 or between about 1:2 and about 2:5.

Advantageously, the weight ratio of aerosol former to sugar in the mixture on a dry weight basis may be about 2:3 and about 1:3 or between about 1:2 and about 2:5.

Advantageously, the weight ratio of aerosol former to binder in the mixture on a dry weight basis may be between about 15:1 and about 1:4 or between about 10:1 and about 1:3.

Advantageously, the weight ratio of aerosol-former to total nicotine in the mixture on a dry weight basis may be less than about 15:1.

The weight ratio of the aerosol-former to total nicotine in the mixture on a dry weight basis may advantageously be between about 3:1 and about 10:1 or between about 4:1 and about 8:1.

As used herein with reference to the invention, the term "total nicotine" is used to describe the total amount by weight of nicotine, nicotine base and nicotine salt in the mixture.

E-cigarettes typically use a liquid formulation in which the weight ratio of aerosol former to nicotine on a dry weight basis is in the range of between about 20:1 and about 100:1. Upon heating such liquid formulations, an aerosol may be generated that has a low nicotine concentration. This may result in users drawing deeper and longer puffs to provide a desired nicotine intake.

The combining step may comprise combining one or more flavourants with the source of nicotine salt and the source of fibrous material to form the mixture.

As used herein with reference to the invention, the term "flavourant" is used to describe any agent that, in use, imparts one or both of a taste or aroma to an aerosol generated by an aerosol-forming substrate comprising the sheet.

The mixture may comprise one or more natural flavourants, one or more artificial flavourants or a combination of one or more natural flavourants and one or more artificial flavourants.

For example, the mixture may comprise one or more flavourants that provide a flavour selected from the group consisting of menthol, lemon, vanilla, orange, wintergreen, cherry, and cinnamon.

The combining step may comprise combining one or more chemesthetic agents with the source of nicotine salt and the source of fibrous material to form the mixture.

As used herein with reference to the invention, the term "chemesthetic agent" is used to describe any agent that, in use, is perceived in the oral or olfactory cavities of a user by means other than, or in addition to, perception via taste receptor or olfactory receptor cells. Perception of chemesthetic agents is typically via a 'trigeminal response', either via the trigeminal nerve, glossopharyngeal nerve, the vagus nerve, or some combination of these. Typically, chemesthetic agents are perceived as hot, spicy, cooling, or soothing sensations.

The mixture may comprise one or more agents that are both a flavourant and a chemesthetic agent. For example, the mixture may comprise menthol or another flavourant that provides a cooling chemesthetic effect.

As used herein with reference to the invention, the term "menthol" is used to describe the compound 2-isopropyl-5-methylcyclohexanol in any of its isomeric forms.

Advantageously, the mixture comprises less than about 15% by weight of tobacco material on a dry weight basis.

The tobacco material content of the mixture may advantageously be less than about 10% by weight on a dry weight basis, less than about 5% by weight on a dry weight basis, less than about 3% by weight on a dry weight basis, less than about 2% by weight on a dry weight basis or less than about 3% by weight on a dry weight basis.

The mixture may comprise substantially no tobacco material.

Advantageously, the combining step may comprise combining water with the source of nicotine salt and the source of fibrous material to form the mixture.

Where the combining step comprises combining water with the source of nicotine salt and the source of fibrous material, the mixture may be an aqueous slurry.

For example, the method may comprise combining the source of nicotine salt, the source of fibrous material, water and any other additional components such as cellulose powder, sugar, a binder and an aerosol former to form an aqueous slurry.

Advantageously, the drying step comprises drying the mixture at a temperature of at least about 100° C.

The drying step may advantageously comprise drying the mixture at a temperature of at least about 110° C. or at least about 120° C.

Advantageously, the drying step comprises drying the mixture at a temperature of less than about 170° C.

The drying step may advantageously comprise drying the mixture at a temperature of less than about 160° C. or at least about 150° C.

The drying step may comprise drying the mixture at a temperature of between about 100° C. and about 170° C., between about 100° C. and about 160° C. or between about 100° C. and about 150° C.

The drying step may comprise drying the mixture at a temperature of between about 110° C. and about 170° C., between about 110° C. and about 160° C. or between about 110° C. and about 150° C.

The drying step may comprise drying the mixture at a temperature of between about 120° C. and about 170° C., between about 120° C. and about 160° C. or between about 120° C. and about 150° C.

Advantageously, the drying step comprises drying the mixture at a temperature of at least about 100° C. for at least about 5 seconds.

The drying step may advantageously comprise drying the mixture at a temperature of at least about 100° C. for at least about 30 seconds, at least about 1 minute, at least about 2 minutes, at least about 3 minutes, at least about 4 minutes or at least about 5 minutes.

The drying step may advantageously comprise drying the mixture at a temperature of at least about 110° C. for at least about 5 seconds, at least about 30 seconds, at least about 1 minute, at least about 2 minutes, at least about 3 minutes, at least about 4 minutes or at least about 5 minutes.

The drying step may advantageously comprise drying the mixture at a temperature of at least about 120° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 100° C. and about 170° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 100° C. and about 160° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 100° C. and about 150° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 110° C. and about 170° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 110° C. and about 160° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 110° C. and about 150° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 120° C. and about 170° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 120° C. and about 160° C. for at least about 5 seconds, at least about 30 seconds, at least about 1 minute, at least about 2 minutes, at least about 3 minutes, at least about 4 minutes or at least about 5 minutes.

The drying step may comprise drying the mixture at a temperature of between about 120° C. and about 150° C. for at least about 5 seconds, at least about 30 seconds, at least about 1 minute, at least about 2 minutes, at least about 3 minutes, at least about 4 minutes or at least about 5 minutes.

Advantageously, the drying step reduces the water content of the mixture by at least about 50 percent.

The drying step may advantageously reduce the water content of the mixture by at least about 60 percent, at least about 70 percent, at least about 80 percent, at least about 90 percent or at least about 95 percent.

The drying step may comprise drying the mixture using suitable known machinery and processes.

The drying step may comprise drying the mixture using one or both of steam and heated air.

The method may further comprise a step of spreading the mixture prior to the drying step.

The method may further comprise a step of shaping the mixture prior to the drying step.

The method may further comprise the step of: extruding the mixture.

The method may further comprise the step of: rolling the mixture.

Advantageously, the method may further comprise the step of: casting the mixture onto a support surface.

More advantageously, the method may comprise the steps of: casting the mixture onto a support surface; drying the cast mixture to form a sheet; and removing the sheet from the support surface.

The method may further comprise the step of: drying the sheet after the removing step. That is the method may comprise a first drying step of drying the cast mixture on the support surface to form a sheet and a second drying step of drying the sheet after the step of removing the sheet from the support surface.

Advantageously, the second drying step comprises drying the sheet at a temperature of at least about 90° C.

The second drying step may advantageously comprise drying the sheet at a temperature of at least about 100° C. or at least about 110° C.

Advantageously, the second drying step comprises drying the sheet at a temperature of less than about 150° C.

The second drying step may advantageously comprise drying the sheet at a temperature of less than about 140° C. or at least about 130° C.

The second drying step may comprise drying the sheet at a temperature of between about 90° C. and about 150° C., between about 90° C. and about 140° C. or between about 90° C. and about 130° C.

The second drying step may comprise drying the sheet at a temperature of between about 100° C. and about 150° C., between about 100° C. and about 140° C. or between about 100° C. and about 130° C.

The second drying step may comprise drying the sheet at a temperature of between about 110° C. and about 150° C., between about 110° C. and about 140° C. or between about 110° C. and about 130° C.

Advantageously, the second drying step comprises drying the sheet at a temperature of at least about 90° C. for at least about 5 seconds.

The second drying step may advantageously comprise drying the sheet at a temperature of at least about 90° C. for at least about 30 seconds, at least about 1 minute, at least about 2 minutes, at least about 3 minutes, at least about 4 minutes or at least about 5 minutes.

The second drying step may advantageously comprise drying the sheet at a temperature of at least about 100° C. for at least about 5 seconds, at least about 30 seconds, at least about 1 minute, at least about 2 minutes, at least about 3 minutes, at least about 4 minutes or at least about 5 minutes.

The second drying step may advantageously comprise drying the sheet at a temperature of at least about 110° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 90° C. and about 150° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 90° C. and about 140° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 90° C. and about 130° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 100° C. and about 150° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 100° C. and about 140° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 100° C. and about 130° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 110° C. and about 150° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 110° C. and about 140° C. for at least about 5 seconds, at least about 30 seconds, at least about 1 minute, at least about 2 minutes, at least about 3 minutes, at least about 4 minutes or at least about 5 minutes.

The second drying step may comprise drying the sheet at a temperature of between about 110° C. and about 130° C. for at least about 5 seconds, at least about 30 seconds, at least about 1 minute, at least about 2 minutes, at least about 3 minutes, at least about 4 minutes or at least about 5 minutes.

The second drying step may comprise drying the sheet using suitable known machinery and processes.

The second drying step may comprise drying the sheet using one or both of steam and heated air.

The sheet may have a width of at least about 20 mm.

Advantageously, the sheet may have a width of at least about 40 mm, at least about 60 mm or at least about 80 mm.

The sheet may have a width of between about 20 mm and about 300 mm, between about 40 mm and about 300 mm, between about 60 mm and about 300 mm or between about 80 mm and about 300 mm.

The sheet may have a thickness of at least about 50 microns.

Advantageously, the sheet may have a thickness of at least about 75 microns, at least about 100 microns or at least about 125 microns.

The sheet may have a thickness of between about 50 microns and about 300 microns, between about 75 microns and about 300 microns, between about 100 microns and about 300 microns or between about 125 microns and about 300 microns.

Advantageously, the method may further comprise the steps of: gathering the sheet transversely relative to a longitudinal axis thereof; and circumscribing the gathered sheet with a wrapper to form a rod.

Advantageously, the method may further comprise the step of: severing the rod into a plurality of discrete aerosol-generating rods.

The method may comprise gathering the sheet transversely relative to a longitudinal axis thereof and circumscribing the gathered sheet with a wrapper to form a rod using conventional cigarette filter making machinery.

For example, the method may comprise gathering the sheet transversely relative to a longitudinal axis thereof and circumscribing the gathered sheet with a wrapper using machinery for forming filter rods comprising a gathered crimped sheet of paper of the type described in CH-A-691156.

The gathered sheet advantageously extends along substantially the entire length of the aerosol-generating rod and across substantially the entire transverse cross-sectional area of the aerosol-generating rod.

Advantageously, the aerosol-generating rod may be of substantially uniform cross-section.

The aerosol-generating rod may advantageously have a rod length of between about 5 mm and about 25 mm, between about 5 mm and about 20 mm or between about 5 mm and about 15 mm.

As used herein with reference to the invention, the term "rod length" is used to describe the maximum dimension in the direction of the cylindrical axis of the aerosol-generating rod.

The aerosol-generating rod may advantageously have a rod diameter of between about 6 mm and about 10 mm, between about 6 mm and about 9 mm or between about 6 mm and about 8 mm.

As used herein with reference to the invention, the term "rod diameter" is used to describe the maximum dimension in a direction substantially perpendicular to the cylindrical axis of the aerosol-generating rod.

The method may comprise circumscribing the gathered sheet with a porous wrapper.

The method may comprise circumscribing the gathered sheet with a non-porous wrapper.

The aerosol-generating rod may be used as a component of an aerosol-generating article.

The aerosol-generating rod may advantageously be used as an aerosol-generating substrate in an aerosol-generating article.

The aerosol-generating rod may particularly advantageously be used as an aerosol-generating substrate in a heated aerosol-generating article.

As used herein, the term "aerosol-generating substrate" is used to describe a substrate capable of releasing volatile compounds upon heating to generate an aerosol.

An inhalable nicotine-containing aerosol is generated upon heating of an aerosol-generating substrate comprising the aerosol-generating rod.

A number of aerosol-generating articles in which an aerosol-forming substrate is heated rather than combusted have been proposed in the art. Typically in heated aerosol-generating articles, an aerosol is generated by the transfer of heat from a heat source, for example a chemical, electrical or combustible heat source, to a physically separate aerosol-generating substrate, which may be located within, around or downstream of the heat source.

The aerosol-generating rod may be used as an aerosol-generating substrate in a heated aerosol-generating article comprising a combustible heat source and an aerosol-generating substrate downstream of the combustible heat source.

For example, the aerosol-generating rod may be used as an aerosol-generating substrate in an aerosol-generating article of the type disclosed in WO 2009/022232 A2 which comprises a combustible carbonaceous heat source, an aerosol-generating substrate downstream of the combustible heat source and a heat-conducting element around and in contact with a rear portion of the combustible carbonaceous heat source and an adjacent front portion of the aerosol-generating substrate. It will be appreciated that the aerosol-generating rod may also be used as an aerosol-generating substrate in heated aerosol-generating articles comprising combustible heat sources having other constructions.

The aerosol-generating rod may be used as an aerosol-generating substrate in a heated aerosol-generating article for use in an electrically-operated aerosol-generating system in which the aerosol-generating substrate of the heated aerosol-generating article is heated by an electrical heat source.

For example, the aerosol-generating rod may be used as an aerosol-generating substrate in an aerosol-generating article of the type disclosed in EP 0 822 760 A2.

An aerosol-generating article may comprise an aerosol-forming substrate comprising the aerosol-generating rod and one or more other elements.

The one or more other elements may include one or more of a support element, a spacer element, an aerosol-cooling element and a mouthpiece.

Advantageously, the method may further comprise the step of: texturing the sheet prior to the gathering step. This may facilitate gathering the sheet transversely relative to a longitudinal axis thereof.

As used herein with reference to the invention, the term "texturing" is used to describe crimping, embossing, debossing, perforating or otherwise deforming the sheet. Textured sheets may comprise a plurality of spaced-apart indentations, protrusions, perforations or a combination thereof.

More advantageously, the method may further comprise the step of: texturing the sheet prior to the gathering step.

As used herein with reference to the invention, the term "crimped sheet" is intended to be synonymous with the term "creped sheet" and is used to describe a sheet having a plurality of substantially parallel ridges or corrugations.

Advantageously, the crimped sheet may have a plurality of ridges or corrugations substantially parallel to the cylindrical axis of the aerosol-generating rod. This may advantageously facilitate gathering the crimped sheet transversely relative to a longitudinal axis thereof.

The method may comprise texturing the sheet using suitable known machinery for texturing filter tow, paper and other materials.

The method may comprise crimping the sheet using a crimping unit of the type described in CH-A-691156, which comprises a pair of rotatable crimping rollers. However, it will be appreciated that the method may comprise texturing the sheet using other suitable machinery and processes that deform or perforate the sheet.

Inclusion of sugar in the mixture may advantageously facilitate texturing of the sheet.

Example

A sheet having the composition shown in Table 1 is prepared by a method according to the invention:

TABLE 1

| Component | Percentage by weight on a dry weight basis (%) |
|---|---|
| Cellulose powder (average particle size 20 microns) | 43.1 |
| Cellulose fibres | 2 |
| Nicotine lactate | 3.2 |
| Sorbitol | 28.7 |
| Guar gum | 3 |
| Glycerine | 20 |

To prepare the sheet the cellulose fibres, glycerine, nicotine lactate (in solution) and water are placed in a tank and stirred for 1 minute at a speed of 1000 rpm. In a separate vessel the cellulose powder, sorbitol and guar gum are manually pre-mixed. The pre-mixed cellulose powder, sorbitol and guar gum is added to the tank comprising the cellulose fibres, glycerine, nicotine lactate (in solution) and water. The resulting mixture is stirred under vacuum (0.8 mbar) for 4 minutes at a speed of 5000 rpm.

The resulting slurry is cast onto a support surface and then dried to form a sheet.

The thickness of the sheet is about 175 microns.

The invention will be further described, by way of example only, with reference to the accompanying drawings in which:

FIG. 1 shows a schematic cross-section of apparatus for forming an aerosol-generating rod from a continuous sheet made by the method of Example 1;

The apparatus shown in FIG. 1 generally comprises: supply means for providing a continuous sheet; crimping means for crimping the continuous sheet; rod forming means for gathering the continuous crimped sheet and circumscribing the gathered material with a wrapper to form a continuous rod; and cutting means for severing the continuous rod into a plurality of discrete aerosol-generating rods. The apparatus also comprises transport means for transporting the continuous sheet downstream through the apparatus from the supply means to the rod forming means via the crimping means.

As shown in FIG. 1, the supply means for providing a continuous sheet comprises a continuous sheet 2 made by the method of Example 1 mounted on a bobbin 4.

The crimping means comprises a pair of rotatable crimping rollers 6. In use, the continuous sheet 2 is drawn from the first bobbin 4 and transported downstream to the pair of crimping rollers 6 by the transport mechanism via a series of guide and tensioning rollers. As the continuous sheet 2 is fed between the pair of crimping rollers 6, the crimping rollers engage and crimp the sheet 2 to form a continuous crimped sheet 8 having a plurality of spaced-apart ridges or corrugations substantially parallel to the longitudinal axis of the sheet through the apparatus.

The continuous crimped sheet 8 is transported downstream from the pair of crimping rollers 6 towards the rod forming means and fed through a converging funnel or horn 10. The converging funnel 10 gathers the continuous sheet 8 transversely relative to its longitudinal axes. The sheet of material 8 assumes a substantially cylindrical configuration as it passes through the converging funnel 10.

Upon exiting the converging funnel 10, the gathered sheet is wrapped in a continuous sheet of wrapper material 12. The wrapper is a paper wrapper and is fed from a bobbin 14 and enveloped around the gathered continuous crimped sheet by an endless belt conveyor or garniture. As shown in FIG. 1, the rod forming means comprises an adhesive application means 16 that applies adhesive to one of the longitudinal edges of the wrapper, so that when the opposed longitudinal edges of the wrapper are brought into contact they adhere to one other to form a continuous rod.

The rod forming means further comprises a drying means 18 downstream of the adhesive application means 16, which in use dries the adhesive applied to the seam of the continuous rod as the continuous rod is transported downstream from the rod forming means to the cutting means.

The cutting means comprises a rotary cutter 20 that severs the continuous rod into a plurality of discrete aerosol-generating rods 22 of unit rod length or multiple unit rod length.

The invention claimed is:

1. A method of making a nicotine containing sheet, comprising:

combining a source of nicotine salt having a cellulose content of less than about 5% by weight on a dry weight basis with a separate source of fibrous material having a nicotine salt content of less than about 1% by weight on a dry weight basis to form a mixture and an aerosol former, wherein the mixture comprises no tobacco material and has an aerosol former content of at least 15% by weight on a dry weight basis; and drying the mixture to form a sheet.

2. The method according to claim 1, wherein the source of nicotine salt comprises one or more nicotine salts of monoprotic carboxylic acids selected from the group consisting of acetic acid, benzoic acid, gallic acid, lactic acid, lauric acid, levulinic acid, palmitic acid, pyruvic acid, sorbic acid, and stearic acid.

3. The method according to claim 1, wherein a weight ratio of fibrous material to nicotine salt in the mixture on a dry weight basis is between about 15:1 and about 1:3.

4. The method according to claim 1, wherein the source of nicotine salt comprises one or more monoprotic nicotine salts.

5. The method according to claim 1, wherein the combining comprises combining cellulose powder with the source of nicotine salt and the separate source of fibrous material to form the mixture.

6. A sheet formed according to claim 5, wherein the cellulose powder has an average particle size of less than about 60 microns.

7. The method according to claim 1, wherein the combining comprises combining sugar with the source of nicotine salt and the separate source of fibrous material to form the mixture.

8. The method according to claim 7, wherein the sugar comprises mannitol, sorbitol, or a combination thereof.

9. The method according to claim 1, wherein the combining comprises combining a binder with the source of nicotine salt and the separate source of fibrous material to form the mixture.

10. The method according to claim 9, wherein the binder comprises one or more natural gum binders selected from the group consisting of guar gum, xanthan gum, and gum arabic.

11. The method according to claim 1, wherein the drying comprises drying the mixture at a temperature of between about 100° C. and about 170° C. for at least about 2 minutes.

12. The method according to claim 1, further comprising:

casting the mixture onto a support surface prior to the drying.

13. The method according to claim 1, further comprising:

gathering the sheet transversely relative to a longitudinal axis thereof;

circumscribing the gathered sheet with a wrapper to form a rod; and severing the rod into a plurality of discrete aerosol-generating rods.

14. The method according to claim 13, further comprising:

crimping the sheet prior to the gathering.

* * * * *